US005752494A

United States Patent [19]

Tuller

[11] Patent Number: 5,752,494

[45] Date of Patent: May 19, 1998

[54] BAND ADAPTER FOR SLINGSHOT

[75] Inventor: Jeffrey Tuller, Rochester, N.Y.

[73] Assignee: Crosman Corporation, East Bloomfield, N.Y.

[21] Appl. No.: 822,678

[22] Filed: Mar. 24, 1997

[51] Int. Cl.[6] ..... F41B 7/00

[52] U.S. Cl. ..... 124/20.1; 124/20.3

[58] Field of Search ..... 124/20.1, 20.3, 124/80

[56] References Cited

U.S. PATENT DOCUMENTS

| | | | |
|---|---|---|---|
| 3,018,770 | 1/1962 | Saunders | 124/20.3 |
| 3,511,221 | 5/1970 | Saunders . | |
| 3,749,075 | 7/1973 | Saunders . | |
| 3,901,209 | 8/1975 | Woolsey . | |
| 3,918,427 | 11/1975 | Turner | 124/20.3 |
| 3,923,034 | 12/1975 | Wolf . | |
| 3,983,860 | 10/1976 | Bolton . | |
| 4,133,333 | 1/1979 | Janssen . | |
| 4,265,212 | 5/1981 | Wolf | 124/20.1 |
| 4,373,503 | 2/1983 | Saunders . | |
| 4,877,007 | 10/1989 | Olson | 124/22 |

*Primary Examiner*—John A. Ricci
*Assistant Examiner*—Thomas A. Beach

[57] ABSTRACT

A band adapter for a slingshot includes a tubular body which may be inserted over the end of a yoke arm of a slingshot and a clip which is engageable with an adjacent portion of the yoke arm for holding the band adapter on the yoke arm.

9 Claims, 2 Drawing Sheets

BAND ADAPTER FOR SLINGSHOT

BACKGROUND

This invention relates to slingshots, and, more particularly, to a band adapter for a slingshot which enables a user to switch to a larger diameter, more powerful, elastic band.

Slingshots commonly use a tubular elastic band which is attached to the ends of a pair of yoke arms on the slingshot. Such elastic bands are described, for example, in U.S. Pat. Nos. 3,901,209 and 4,133,333. The size or diameter of the elastic band is determined by the size of the yoke ends. Each end of the band must fit tightly over the yoke end so that the band is frictionally retained on the yoke when the band is stretched.

A user of a slingshot often wishes to use a more powerful elastic band in order to create a greater force. More power can be obtained by using a larger band with a bigger diameter. However, a bigger diameter band will not be retained on the yoke ends when the band is stretched.

SUMMARY OF THE INVENTION

The invention provides removable band adapters which can be inserted over the yoke ends of a slingshot in order to increase the effective diameter of the yoke ends and to allow use of a bigger diameter elastic band. The band adapter includes a body portion which is rotatably mounted on a yoke end and a clip portion which is rotated into engagement with a portion of the yoke to retain the band adapter on the yoke when the band is stretched.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
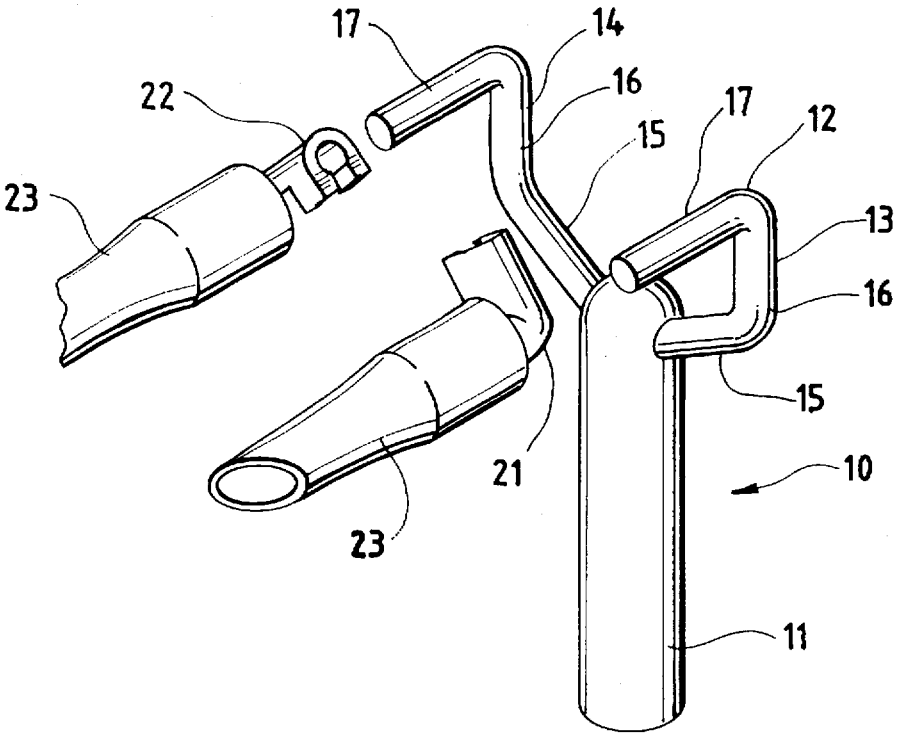
FIG. 1 is a fragmentary exploded perspective view of a slingshot, a pair of band adapters which are formed in accordance with the invention, and an elastic band.
Figure 2:
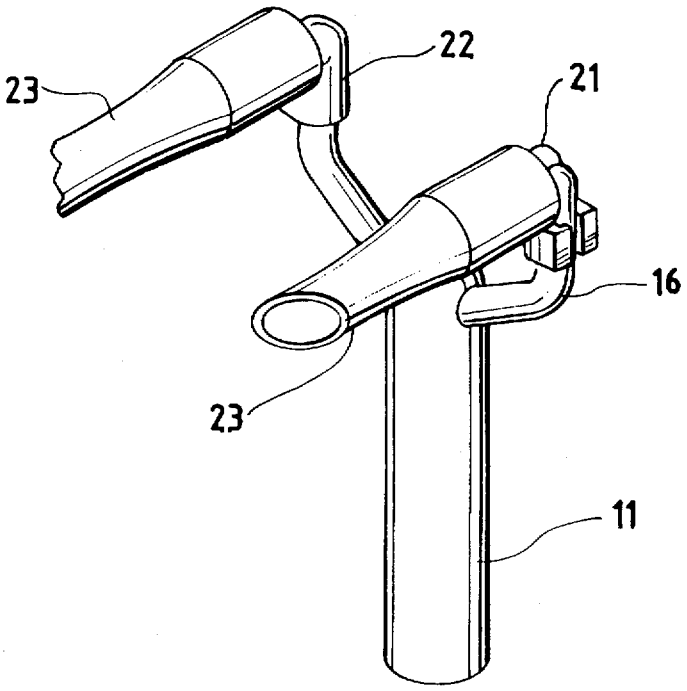
FIG. 2 is a fragmentary perspective view showing the band adapters mounted on the slingshot.

FIG. 1 illustrates a conventional slingshot 10 which includes an elongated handle 11 and a yoke 12. In the particular embodiment illustrated, the yoke includes right and left yoke arms 13 and 14 which extend separately from the handle. Other types of yokes may include a single mounting portion which extends from the handle and a pair of arms which extend from the mounting portion. Each yoke arm includes a first portion 15 which extends angularly from the handle, an intermediate portion 16 which extends generally parallel to the axis of the elongated handle, and an end portion 17 which extends perpendicularly to the adjacent portion 16 and to the axis of the handle. At least the end portions 17 of the yoke are cylindrical, and it is convenient to make the entire yoke from a cylindrical metal rod.

FIG. 1 illustrates right and left band adapters 21 and 22 about to be mounted on the end portions 17 of the yoke arms 13 and 14. A tubular elastic band 23 is inserted over each of the band adapters and is frictionally retained thereon. A single elastic band may extend continuously from one band adapter to the other, or two separate elastic bands can be used which are each connected to a conventional pouch. The elastic band 23 is a conventional elastic band for slingshots. However, the diameter of the band 23 is larger than the diameter of a band which could be frictionally retained on the yoke ends 17 without the band adapters.

Referring to FIGS. 4–8, each of the band adapters 21 and 22 includes a tubular body 25, an arm 26 which extends axially from the body, and a clip portion 27 which extends perpendicularly to the axis of the tubular body. The tubular body 25 has a cylindrical outer surface 28, and the forward end of the cylindrical surface terminates at a radially inwardly extending shoulder 29. A cylindrical bore 30 extends through tubular body, and the bore is sized so that the body can be rotatably mounted on a yoke end 17.

The arm 26 is generally U-shaped in cross section and includes a curved inside surface 32 (FIG. 8) which has the same radius as the bore 30.

The clip portion 27 is also generally U-shaped or channel-shaped and includes a pair of end portions 33 and a center or bight portion 34. The bight portion has a curved inside surface 35 (FIG. 7) which forms a trough or channel 36 which extends perpendicularly to the bore of the body portion and which is sized to receive the intermediate portion 16 of the yoke arm. The curved surface 35 advantageously has substantially the same radius as the intermediate portion 16.

Each of the end portions 33 of the clip includes an inside surface 37 which provides the clip with a restricted throat 38 which is narrower than the channel 36. The surfaces 37 diverge outwardly to facilitate camming the intermediate portion 16 of the yoke arm through the throat and into the channel. The surfaces 37 terminate in shoulders 39 which retain the intermediate portion 16 in the channel.

The band adapters are advantageously molded from plastic. One specific embodiment was molded from Nylon 6/6 having 30% glass content.

The right and left band adapters 21 and 22 are mirror images. The right hand adapter 21 is mounted on the yoke end 17 of the right yoke arm 13 by inserting the yoke end axially into the bore of the body portion as illustrated in FIG. 1. The clip portion 27 is positioned so that it does not engage the adjacent portion 16 of the yoke arm. The adapter is then rotated counterclockwise on the yoke end to force the clip 17 over the adjacent portion 16 of the yoke arm. The clip is retained on the yoke portion 16 by the restricted throat 38 and the shoulders 39.

Figure 3:
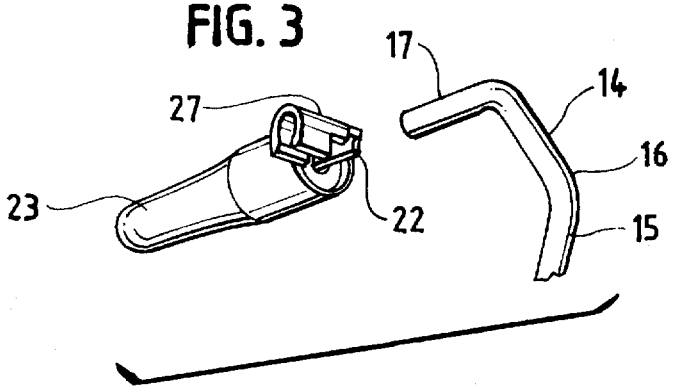
FIG. 3 is a fragmentary perspective view showing the band adapter in the process of being mounted on the yoke on the slingshot.
Figure 4:
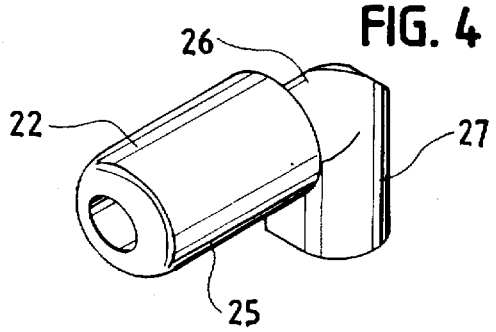
FIG. 4 is a perspective view of the left band adapter.
Figure 5:
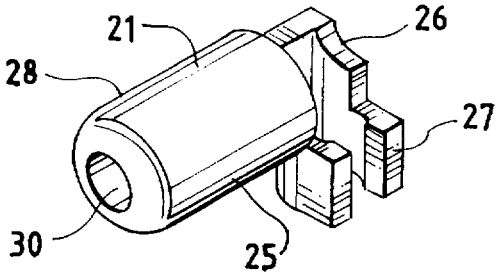
FIG. 5 is a perspective view of the right band adapter.
Figure 6:
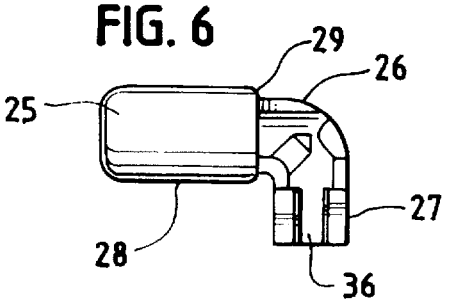
FIG. 6 is a right side view of the right band adapter.
Figure 8:
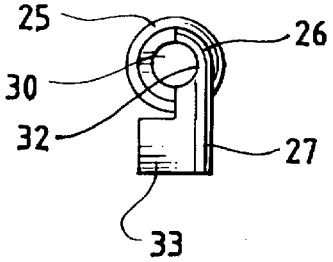
FIG. 8 is an end view of the band adapter of FIG. 6.
Figure 7:
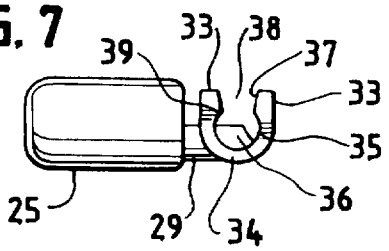
FIG. 7 is a bottom view of the band adapter of FIG. 6.

The left band adapter is mounted in a similar fashion but is rotated clockwise in FIGS. 1 and 3 to force the clip over the yoke portion 16. If desired, however, the same band adapter can be used on both the right and left yoke arms.

The elastic band 23 can be mounted on the band adapter either before or after the band adapters are mounted on the yoke. If desired, each end of the band can be pulled over the shoulder 29 of the body portion to increase the frictional retention force between the band and the band adapters.

Since the clip portion of each of the band adapters engages the portion 16 of the yoke arm which extends perpendicularly to the yoke end 17, the clip holds the band adapter on the yoke when the elastic band is stretched. The restricted throat of the clip prevents inadvertent detachment of the clip from the yoke. When it is desired to remove the band adapter, the band adapter is simply rotated on the yoke end 17 to force the yoke portion 16 through the throat.

The band adapters allow the user of the slingshot to switch easily from one size band to another. A relatively small diameter band can be inserted directly onto the yoke ends 17. A larger, more powerful band can be used by using the band adapters. Even more versatility can be provided by using band adapters having body portions with different outside diameters.

While in the foregoing specification a detailed description of specific embodiments of the invention were set forth for the purpose of illustration, it will be understood that many of the details herein given can be varied considerably by those skilled in the art without departing from the spirit and scope of the invention.

I claim:

1. A band adapter for a slingshot comprising a tubular body having an outer surface which is adapted to be inserted into a tubular elastic band and an internal bore which is adapted to receive a yoke of a slingshot, and locking means extending from the body and adapted to removable engage the yoke for preventing withdrawal of the body from the yoke when the elastic band is stretched and when the locking means engages the yoke.

2. The band adapter of claim 1 in which the bore is generally cylindrical and the locking means includes an arm which extends from the body and a generally channel-shaped clip on the arm which provides a channel having an axis which extends generally perpendicularly to the axis of the cylindrical bore.

3. The band adapter of claim 2 in which the clip includes a pair of spaced-apart end portions which define a restricted throat for the channel and a bight portion which defines said channel, the throat being narrower than the channel.

4. The band adapter of claim 3 in which each of the end portions includes an inside surface, the inside surfaces diverging from said channel.

5. The band adapter of claim 1 in which the tubular body includes a radially inwardly extending shoulder between the body and the locking means.

6. In combination, a slingshot and a pair of band adapters, the slingshot having an elongated handle and a pair of yoke arms mounted on the handle, each of the yoke arms including a generally cylindrical end portion which extends generally perpendicularly to the handle and a second portion which extends generally perpendicularly to the end portion, each of the band adapters having a tubular body having an outer surface which is adapted to be inserted into a tubular elastic band and a generally cylindrical internal bore into which the end portion of one of the yoke arms is rotatably inserted, and a generally channel-shaped clip attached to the body which provides a channel into which the second portion of one of the yoke arms is inserted, whereby the clip prevents the band adapter from being withdrawn from the end portion of the yoke arm when a force is exerted on the band adapter in a direction which extends parallel to the end portion of the yoke arm.

7. The structure of claim 6 in which the clip of each band adapter includes a pair of spaced-apart end portions which define a restricted throat for the channel and a bight portion which defines said channel, the throat being narrower than the channel, whereby the end portions of the clip are engageable with the second portion of the yoke arm for restraining rotation of the band adapter relative to the end portion of the yoke arm.

8. The structure of claim 7 in which each of the end portions includes an inside surface, the inside surfaces diverging from said channel.

9. The structure of claim 6 in which the tubular body of each of the band adapters includes a radially inwardly extending shoulder between the body and the clip.

* * * * *